US010684588B2

(12) United States Patent
Wakai et al.

(10) Patent No.: US 10,684,588 B2
(45) Date of Patent: Jun. 16, 2020

(54) IMAGE FORMING UNIT AND IMAGE FORMING APPARATUS

(71) Applicant: FUJI XEROX CO., LTD., Tokyo (JP)

(72) Inventors: Takafumi Wakai, Kanagawa (JP); Takashi Akaike, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/286,624

(22) Filed: Feb. 27, 2019

(65) Prior Publication Data

US 2020/0096939 A1 Mar. 26, 2020

(30) Foreign Application Priority Data

Sep. 25, 2018 (JP) ..... 2018-178509

(51) Int. Cl.
*G03G 21/20* (2006.01)
*G03G 15/08* (2006.01)

(52) U.S. Cl.
CPC ..... *G03G 21/206* (2013.01); *G03G 15/0898* (2013.01)

(58) Field of Classification Search
CPC ..... G03G 15/0898; G03G 21/206
See application file for complete search history.

(56) References Cited

U.S. PATENT DOCUMENTS

2016/0033919 A1* 2/2016 Egi ..... G03G 15/6529 399/397
2017/0315493 A1* 11/2017 Satake ..... G03G 15/6561

FOREIGN PATENT DOCUMENTS

JP 2007226113 A * 9/2007
JP 2015-079134 4/2015

* cited by examiner

*Primary Examiner* — David M. Gray
*Assistant Examiner* — Andrew V Do
(74) *Attorney, Agent, or Firm* — JCIPRNET

(57) ABSTRACT

An image forming unit includes a developing device, a guiding member, and a sealing member. The developing device develops an electrostatic latent image formed on an image carrier that rotates. The developing device has a first ventilation hole that serves as a flow path for an airflow that is generated by rotation of the image carrier. The guiding member guides a recording material to the image carrier. The guiding member has a second ventilation hole that forms the flow path for the airflow in cooperation with the first ventilation hole. The sealing member is disposed between the first ventilation hole and the second ventilation hole. The sealing member has a first end in contact with the developing device and a second end in contact with the guiding member.

11 Claims, 4 Drawing Sheets

IMAGE FORMING UNIT AND IMAGE FORMING APPARATUS

CROSS-REFERENCE TO RELATED APPLICATIONS

This application is based on and claims priority under 35 USC 119 from Japanese Patent Application No. 2018-178509 filed Sep. 25, 2018.

BACKGROUND

(i) Technical Field

The present disclosure relates to an image forming unit and an image forming apparatus.

(ii) Related Art

In the related art, there is a technology that suppress a toner cloud, which is a toner that floats from a developing device, from flowing into a transport path of a recording material in an image forming apparatus.

For example, Japanese Unexamined Patent Application Publication No. 2015-79134 describes a feature in which an airflow path is formed between a guiding member that transports a recording material and a developing device to guide a toner cloud.

SUMMARY

Aspects of non-limiting embodiments of the present disclosure relate to a unit that suppresses a toner cloud from dispersing from a flow path between a guiding member and a developing device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming unit including a developing device that develops an electrostatic latent image formed on an image carrier that rotates, the developing device having a first ventilation hole that serves as a flow path for an airflow that is generated by rotation of the image carrier, a guiding member that guides a recording material to the image carrier, the guiding member having a second ventilation hole that forms the flow path for the airflow in cooperation with the first ventilation hole, and a sealing member that is disposed between the first ventilation hole and the second ventilation hole, the sealing member having a first end in contact with the developing device and a second end in contact with the guiding member.

BRIEF DESCRIPTION OF THE DRAWINGS

An exemplary embodiment of the present disclosure will be described in detail based on the following figures, wherein.

DETAILED DESCRIPTION

Exemplary Embodiment

Figure 1:
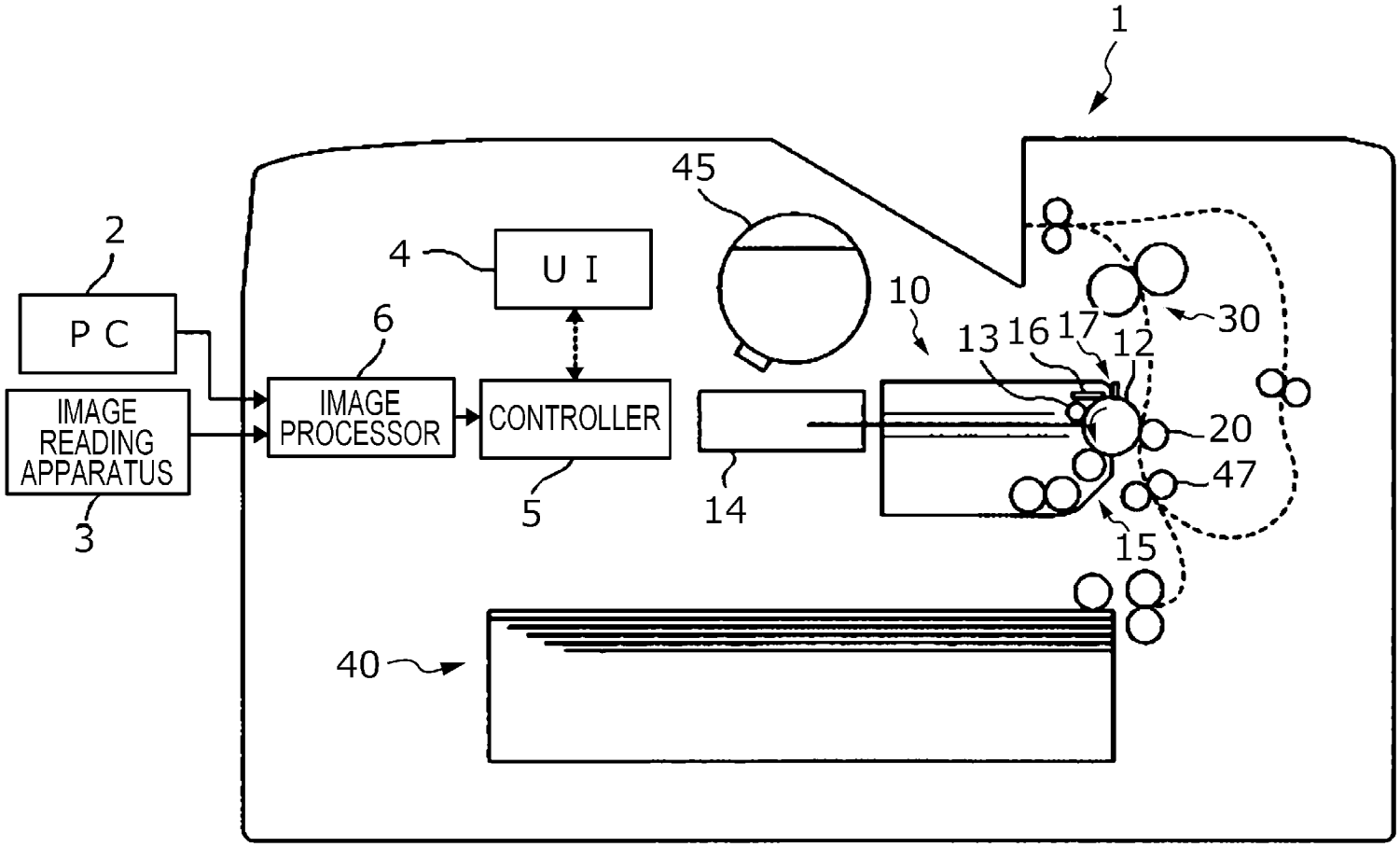
FIG. 1 is an illustration of a configuration of an image forming apparatus according to an exemplary embodiment.

FIG. 1 is an illustration of a configuration of an image forming apparatus 1 according to an exemplary embodiment of the present disclosure. The image forming apparatus 1 includes an image forming unit 10 that forms an image in accordance with image data, a user interface (UI) 4 that receives an instruction from a user and displays a massage and the like for the user, a controller 5 that controls an operation of the entire image forming apparatus 1, and an image processor 6 that is connected to external devices, for example, a personal computer (PC) 2 and an image reading apparatus 3, and that applies image processing to image data that is received from these external apparatus.

The image forming apparatus 1 also includes a recording-material supplying unit 40 that supplies a recording material (for example, a sheet-shaped paper) to the image forming unit 10 and a toner cartridge 45 that supplies a toner to the image forming unit 10.

The image forming unit 10 includes a photoconductor drum 12, a charging device 13, and an exposure device 14. The photoconductor drum 12 is an image carrier that is disposed so as to be rotatable and that carries a toner image by forming an electrostatic latent image. The charging device 13 charges a surface of the photoconductor drum 12. The exposure device 14 exposes the photoconductor drum 12 charged by the charging device 13 to light in accordance with image data.

The image forming unit 10 further includes a developing device 15 and a cleaner 16. The developing device 15 develops an electrostatic latent image formed on the photoconductor drum 12. The cleaner 16 cleans the surface of the photoconductor drum 12 after an image is transferred. In the present exemplary embodiment, the photoconductor drum 12 includes a rotary shaft, which is not illustrated. The photoconductor drum 12 is arranged such that the axial direction of the rotary shaft extends from the front side (near side in FIG. 1) to the rear side (far side in FIG. 1) of the image forming apparatus 1.

In addition, the image forming unit 10 includes a transfer roller 20, a fixing device 30, a peeling member 17, and at least one transport roller 47. The transfer roller 20 forms a transfer section between the transfer roller 20 and the photoconductor drum 12 and transfers a toner image formed on the photoconductor drum 12 to a recording material. The fixing device 30 fixes a transferred toner image onto a recording material. The peeling member 17 peels a recording material on which a toner image is transferred by the transfer roller 20 from the surface of the photoconductor drum 12. The at least one transport roller 47 transports a recording material toward the transfer roller 20.

Figure 2:
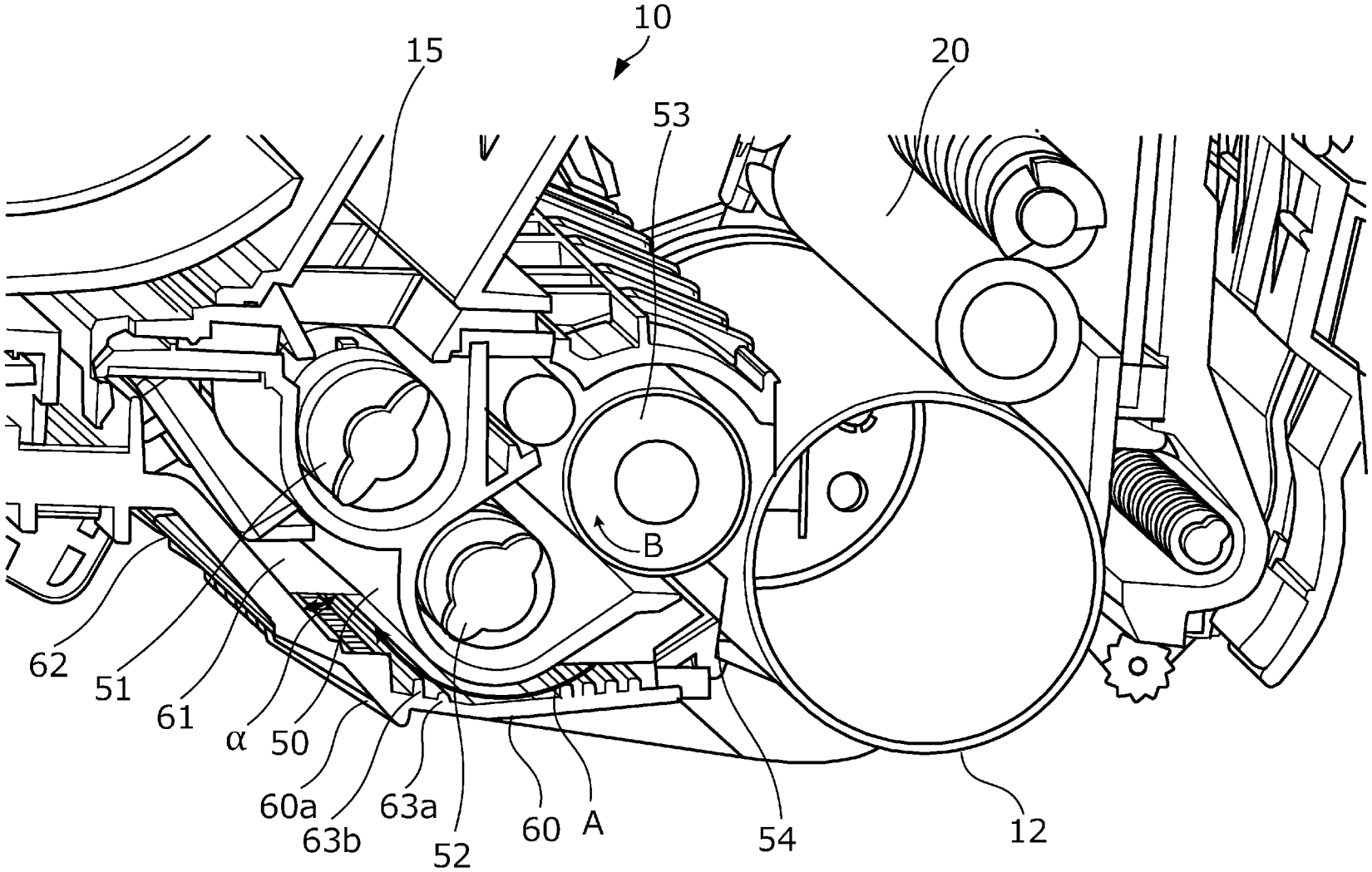
FIG. 2 is an illustration of a configuration of an image forming unit according to an exemplary embodiment.

FIG. 2 is an illustration of a detailed configuration of the image forming unit 10. In FIG. 2, illustrations of the exposure device 14, the charging device 13, the cleaner 16, the peeling member 17, and the at least one transport roller 47 in FIG. 1 are omitted.

The image forming unit 10 includes a transporting chute 60 as a guiding member that transports and guides a recording material transported by the at least one transport roller 47 to the transfer roller 20. The charging device 13 includes a charging roller 13*a* that is in contact with the surface of the photoconductor drum 12. The charging device 13 charges the surface of the photoconductor drum 12 by applying voltage to the charging roller 13*a*.

The exposure device 14 radiates, for example, laser light onto the surface of the photoconductor drum 12 and thereby exposes the photoconductor drum 12 charged by the charging device 13 to the light. Specifically, the exposure device 14 selectively exposes the surface of the photoconductor drum 12 that is negatively charged by the charging device 13 to light to selectively reduce a surface potential of the photoconductor drum 12, thereby forming an electrostatic latent image on the surface of the photoconductor drum 12.

The developing device 15 includes a developing housing 50 and a developing roller 53. The developing housing 50 is a storage member in which a developer is stored. In the present exemplary embodiment, a two-component developer (an example of a "first component" and a "second component") that contains a charged toner and a carrier, the carrier being magnetic particles, is used as the developer. The developing housing 50 includes a first auger 51 and a second auger 52 that are arranged in parallel to the axial direction of the photoconductor drum 12. The developing housing 50 transports the developer to the developing roller 53. The developing housing 50 has a face that faces the transporting chute 60 with a predetermined gap therebetween.

The developing roller 53 is a developing member that carries a developer and develops an electrostatic latent image on the photoconductor drum 12 with the developer. The developing roller 53 is disposed so as to face the photoconductor drum 12 and is driven to rotate in an arrow B direction by a driving unit, which is not illustrated. In the present exemplary embodiment, the developing roller 53 is driven to rotate such that a linear velocity on a surface of the developing roller 53 is higher than a linear velocity on the surface of the photoconductor drum 12.

The transporting chute 60 extends along a face of the photoconductor drum 12 extending in a rotation axis direction and faces the face of the developing housing 50 with the gap therebetween. In the present exemplary embodiment, the transporting chute 60 is detachable from the developing housing 50. The transporting chute 60 guides, on a face thereof on a side opposite to a side facing the developing housing 50, a recording material transported by the at least one transport roller 47 toward the transfer roller 20. Hereinafter, a face of the transporting chute 60 facing the developing housing 50 is referred to as an "inner wall surface".

The sectional shape of a surface of the transporting chute 60 perpendicular to the rotation axis direction of the photoconductor drum 12 is an arc shape in the vicinity of a portion 60*a* in FIG. 2 and is a flat shape in other portions. Therefore, a second ventilation hole 62 may be provided at a position higher than the position of a first ventilation hole 54.

The first ventilation hole 54 is provided in the developing housing 50 on a side of the developing roller 53. The second ventilation hole 62 is provided in the transporting chute 60. An airflow that is generated as a result of the rotation of the photoconductor drum 12 and the rotation of the developing roller 53 enters a path between the developing housing 50 and the transporting chute 60 through the first ventilation hole 54 and travels toward the second ventilation hole 62. The first ventilation hole 54 and the second ventilation hole 62 will be described later. Arrow A indicates an airflow that flows from the first ventilation hole 54 to the second ventilation hole 62.

A sealing member 61 that has a film shape and a rectangular shape is disposed in the path between the developing housing 50 and the transporting chute 60 on a side of the second ventilation hole 62. The axial direction of the photoconductor drum 12 coincides with the longitudinal direction of the rectangular shape of the sealing member 61. The sealing member 61 is in contact with the developing housing 50 at a first long-side portion of the rectangular shape and in contact with the transporting chute 60 at a second long-side portion of the rectangular shape.

The transporting chute 60 has projections 63*a* and 63*b*. The projections 63*a* and 63*b* project from the inner wall surface of the transporting chute 60 toward the developing housing 50. The projections 63*a* and 63*b* each have a shape extending in the rotation axis direction of the photoconductor drum 12 (or the developing roller 53). In the present exemplary embodiment, the projections 63*a* and 63*b* extend in the rotation axis direction of the photoconductor drum 12 throughout a region in which the second ventilation hole 62 is provided. The projection 63*b* is positioned closer than the projection 63*a* to the second ventilation hole 62. The projection 63*b* (an example of a "first projection") is higher than the projection 63*a* (an example of a "second projection").

An angle $\alpha$ (an example of a "contact angle") that is formed by the sealing member 61 and the inner wall surface of the transporting chute 60 as viewed in a travelling direction of an airflow is an acute angle.

Figure 3:
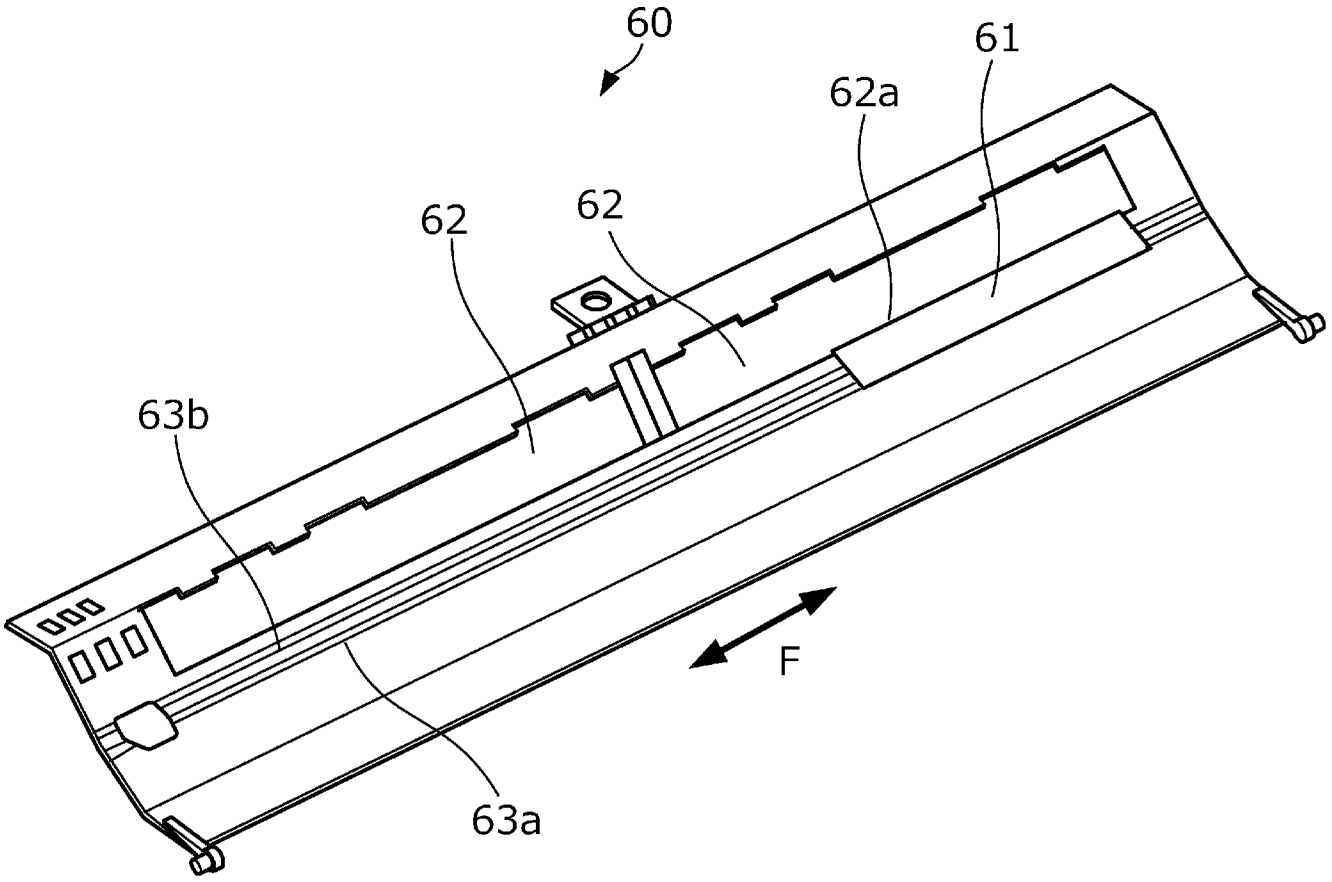
FIG. 3 is a perspective view of a transporting chute according to an exemplary embodiment as viewed from a developing device.

FIG. 3 is a perspective view of the transporting chute 60 as viewed from the developing device 15. As illustrated in FIG. 3, the transporting chute 60 has the second ventilation hole 62 that has two apertures. The sealing member 61 is disposed on one side in the rotation axis direction (arrow F direction in FIG. 3) of the photoconductor drum 12 (or the developing roller 53). As illustrated in FIG. 3, the sealing member 61 may not have a length corresponding to the whole length of the photoconductor drum 12 (or the developing roller 53) in the rotation axis direction of the photoconductor drum 12 (or the developing roller 53). The sealing member 61 may have at least a length corresponding to only a portion of the photoconductor drum 12 (or the developing roller 53) in the rotation axis direction of the photoconductor drum 12 (or the developing roller 53).

The first long-side portion of the sealing member 61 adheres to the transporting chute 60 via an adhesive or the like. An adherence surface reaches an end portion 62*a* of the second ventilation hole 62. The sealing member 61 overlaps the end portion 62*a*. In a state in which the transporting chute 60 is attached to the developing device 15, the second long-side portion of the sealing member 61 is in contact with the developing housing 50. The sealing member 61 is disposed at a position at which at least a portion of the projections 63*a* and 63*b* overlaps the sealing member 61 when the sealing member 61 is viewed in the vertical direction.

Figure 4:
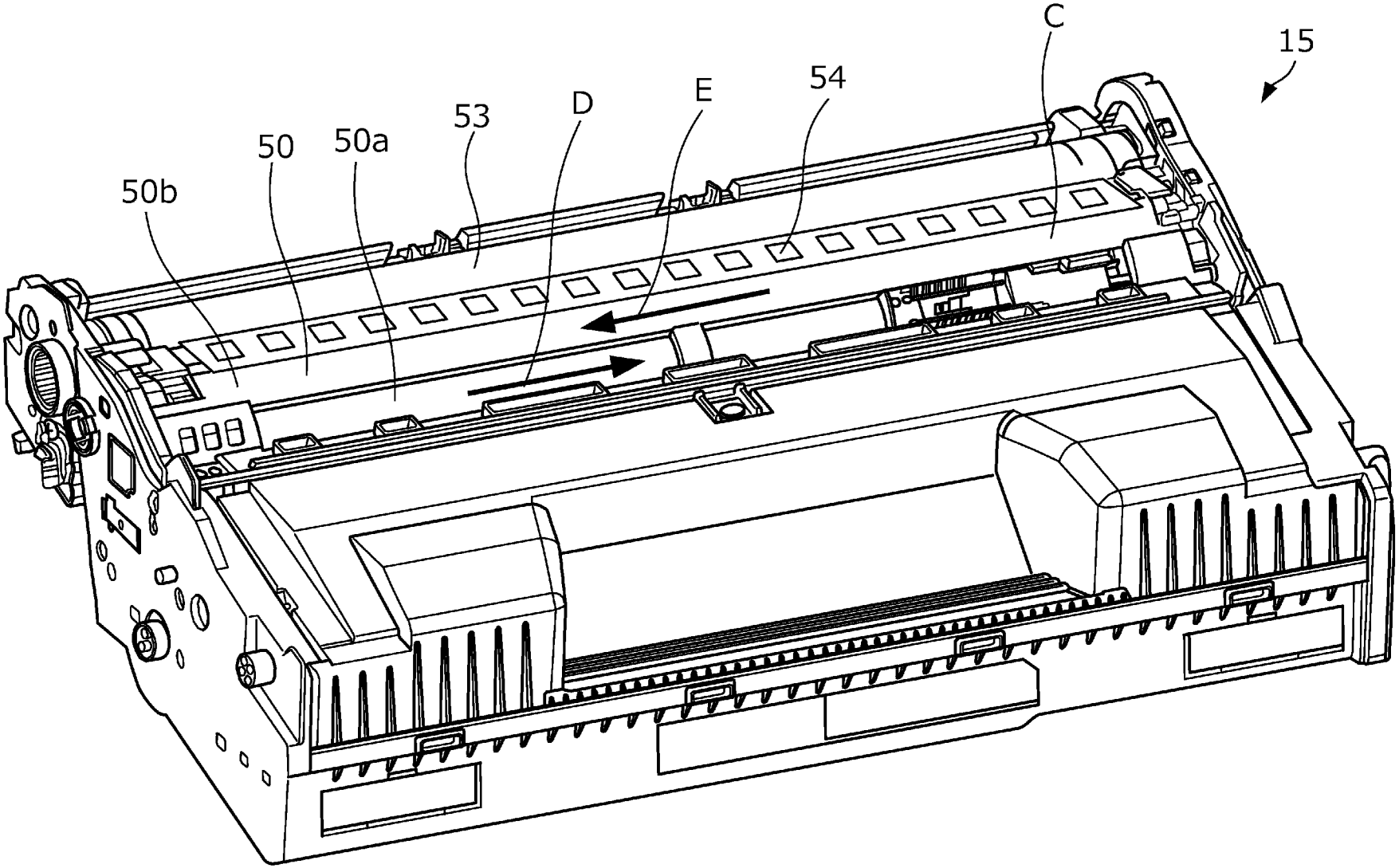
FIG. 4 is a perspective view of the developing device according to an exemplary embodiment as viewed from the transporting chute.

FIG. 4 is a perspective view of the developing device 15 as viewed from the transporting chute 60. As illustrated in FIG. 4, the developing device 15 has the first ventilation hole 54 at a position in the developing housing 50 on the side of the developing roller 53. The first ventilation hole 54 includes a plurality of apertures that are arranged in the rotation axis direction of the photoconductor drum 12 (or the developing roller 53). In the state in which the transporting chute 60 is attached to the developing device 15, the sealing member 61 is in contact with, of a surface of the developing housing 50, a portion having the center thereof at a position C. The contacted portion extends in the rotation axis direction of the photoconductor drum 12 (or the developing roller 53). The surface of the developing housing 50 has a cylindrical shape and thus has an R-shape (an example of an "arc portion") around the position C. Consequently, the sealing member 61 may be in contact with the contacted portion with high sealability.

The developing housing 50 stores a developer and supplies the developer to the developing roller 53. The developing housing 50 includes a first chamber 50*a* provided with the first auger 51 and a second chamber 50*b* provided with the second auger 52. The first auger 51 transports the developer in arrow D direction while stirring the developer in the first chamber 50*a*. The developer is discharged into the second chamber 50*b* upon reaching the downstream side in arrow D direction. The second auger 52 supplies the developer that is received in the second chamber 50*b* from the first chamber 50*a* to the developing roller 53 while stirring and transporting the developer in arrow E direction.

The developing roller 53 causes the supplied developer to adhere to the surface thereof by using a magnetic force and transports the developer to a position in the photoconductor drum 12 opposite to the developing roller 53. An electrostatic latent image that is formed on the surface of the photoconductor drum 12 is then developed with the toner in the developer. Consequently, a toner image is formed on the surface of the photoconductor drum 12. After the development with the toner, the developer adhering to the surface of the developing roller 53 is returned to the second chamber 50*b* and returned to the first chamber 50*a* from the downstream side of the second chamber 50*b*. The developer is thus caused to circulate in the first chamber 50*a* and the second chamber 50*b* by the first auger 51 and the second auger 52.

When development with the toner described above is repeated, the amount of the toner contained in the circulating developer is decreased. Thus, a toner supply port is provided on the upstream side of the first chamber 50*a*. A toner is supplied through the toner supply port and transported to the downstream side of the first chamber 50*a* and stirred by the first auger 51. In the present exemplary embodiment, a side toward which arrow D is directed and a side toward which arrow E is directed, arrow D and arrow E indicating a circulation direction of the developer in FIG. 4, are both referred to as the downstream side. A side opposite to the side toward which arrow D is directed and a side opposite to the side toward which arrow E is directed are both referred to as the upstream side.

In the developing housing 50, as a result of, for example, the first auger 51 and the second auger 52 stirring the developer and supplying the developer from the first chamber 50*a* to the second chamber 50*b*, the toner is stirred up inside the developing housing 50, which may cause a toner cloud. The rotation of each of the first auger 51, the second auger 52, and the developing roller 53 generates an airflow that flows into the developing housing 50. As a result, the pressure inside the developing housing 50 becomes high compared to that outside the developing housing 50. Consequently, air leaks out from inside the developing housing 50, which may cause the toner cloud generated inside the developing housing 50 to leak out from the developing housing 50 and float around the developing device 15.

In particular, the concentration of the toner tends to be higher and the concentration of a generated toner cloud also tends to be higher on the upstream side of the second chamber 50*b*, from which the developer is supplied to the developing roller 53, in arrow E direction than those on the downstream side of the second chamber 50*b* in arrow E direction because the developer is supplied from the first chamber 50*a* on the upstream side.

In the present exemplary embodiment, an airflow is guided from the first ventilation hole 54 that is provided in the developing housing 50 on the side of the developing roller 53 to the second ventilation hole 62 that is provided in the transporting chute 60. In addition, the toner cloud floating around the developing device 15 is guided to the path between the transporting chute 60 and the developing housing 50 so as not to disperse in other places.

In the present exemplary embodiment, the sealing member 61 is disposed at a position so as to overlap the second ventilation hole 62 as viewed in a direction perpendicular to the flow path of the airflow indicated by arrow A in FIG. 2. In other words, in FIG. 3, the sealing member 61 adheres at a position so as to overlap the end portion 62*a* of the second ventilation hole 62, as described above. Therefore, the toner cloud that is caused to flow toward the second ventilation hole 62 by the airflow indicated by arrow A (refer to FIG. 2) may not tend to disperse from the gap between the transporting chute 60 and the developing housing 50 to other places.

In the present exemplary embodiment, the sealing member 61 is disposed at a position in the second ventilation hole 62 in the rotation axis direction (direction identical to arrow E direction in FIG. 4) of the photoconductor drum 12 on the upstream side of the second chamber 50*b* in arrow E direction. As described above, the concentration of the toner tends to be high, and the concentration of a generated toner cloud also tends to be higher on the upstream side of the second chamber 50*b* in arrow E direction than those on the downstream side of the second chamber 50*b* in arrow E direction.

Thus, on the upstream side of the second chamber 50*b* in arrow E direction, a generation amount of the toner cloud is larger than that on the downstream side thereof. The toner cloud thus tends to disperse from the second ventilation hole 62 of the transporting chute 60. In the present exemplary embodiment, the sealing member 61 is disposed, in the rotation axis direction of the photoconductor drum 12 (direction identical to arrow E direction in FIG. 4), at the portion around the position C, the portion corresponding to only a portion of the second chamber 50*b* on the upstream side in arrow E direction (that is, on the upstream side in the circulation direction of the developer). The provision of the sealing member 61 may suppress the toner cloud generated on the upstream side of the second chamber 50*b* in arrow E direction from dispersing from the second ventilation hole 62.

The toner cloud generated on the upstream side of the second chamber 50*b* in arrow E direction is caused to flow toward the second ventilation hole 62 along with the airflow. The toner cloud, however, does not immediately reach the second ventilation hole 62 because of the provision of the sealing member 61. The airflow is interrupted by the sealing member 61, which causes the airflow to swirl between the sealing member 61 and a face of the transporting chute 60. Consequently, the toner cloud also remains between the sealing member 61 and the face of the transporting chute 60. Part of the remaining toner cloud moves along the sealing member 61 toward the downstream side of the second chamber 50*b* in arrow E direction and travels toward the second ventilation hole 62 by deviating from the airflow interrupted by the sealing member 61. A path along which the part of the remaining toner cloud travels to the second ventilation hole 62 after the toner cloud is generated is lengthened by the sealing member 61. Consequently, an arrival of a large amount of the toner cloud to the second ventilation hole 62 may be suppressed.

Moreover, provision of the projections 63*a* and 63*b* on the inner wall surface of the transporting chute 60 may reduce the velocity of the airflow at a portion where the sealing member 61 is disposed. Consequently, the toner cloud may be suppressed from dispersing from the second ventilation hole 62.

As a result of the angle α that is formed by the sealing member 61 and the inner wall surface of the transporting chute 60 as viewed in the travelling direction of the airflow being an acute angle, the airflow tends to swirl between the sealing member 61 and the face of the transporting chute 60.

MODIFICATIONS

The aforementioned exemplary embodiment may be variously modified. Examples of modifications are presented below. The aforementioned exemplary embodiment and the modifications presented below may be combined together, as appropriate.

(1) In the aforementioned exemplary embodiment, the sealing member 61 is a film-shaped member and adheres to the transporting chute 60 so as to be in contact with the surface of the developing housing 50. The sealing member 61, however, may adhere to the developing housing 50 so as to be in contact with the transporting chute 60.

(2) In the aforementioned exemplary embodiment, the sealing member 61 is a film-shaped member and adheres to the transporting chute 60. The sealing member 61 is however not limited to the film-shaped member. In addition, the sealing member 61 may be integral with the transporting chute 60 and may be integral with the developing housing 50.

(3) In the aforementioned exemplary embodiment, the angle α that is formed by the sealing member 61 and the inner wall surface of the transporting chute 60 as viewed in the travelling direction of the airflow is an acute angle. The angle α is, however, not limited thereto. An angle that is formed by the sealing member 61 and a face of the developing housing 50 as viewed in the travelling direction of the airflow may be an acute angle.

(4) In the aforementioned exemplary embodiment, the airflow generated by the rotation of the photoconductor drum 12 or the rotation of the developing roller 53 is guided to the path extending from the first ventilation hole 54 to the second ventilation hole 62. The airflow is however not limited thereto. An airflow may be generated in the path extending from the first ventilation hole 54 to the second ventilation hole 62 by a cooling fan disposed outside the second ventilation hole 62 of the transporting chute 60.

(5) In the aforementioned exemplary embodiment, the projections 63*a* and 63*b* extend in the rotation axis direction of the photoconductor drum 12 throughout the region in which the second ventilation hole 62 is provided. The projections 63*a* and 63*b* are however not limited thereto. The projections 63*a* and 63*b* may extend in at least a location where the sealing member 61 is disposed.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming unit comprising:

a developing device that develops an electrostatic latent image formed on an image carrier that rotates;

a guiding member that guides a recording material to the image carrier; and a sealing member that is disposed between a first ventilation hole and a second ventilation hole, the sealing member having a first end in contact with the developing device and a second end in contact with the guiding member, wherein the first ventilation hole serves as a flow path for an airflow that is generated by rotation of the image carrier, and the second ventilation hole forms the flow path for the airflow in cooperation with the first ventilation hole, wherein the sealing member has a shape having a longitudinal direction that coincides with an axial direction of the image carrier, and wherein the sealing member has a length corresponding to only a portion of the image carrier in the axial direction.

2. The image forming unit according to claim 1, wherein the sealing member is disposed at a position corresponding to only a portion of the developing device on an upstream side in a direction in which a toner is stirred and transported.

3. The image forming unit according to claim 2, wherein the sealing member is disposed at a position so as to overlap an end portion of the second ventilation hole as viewed in a direction perpendicular to the flow path.

4. The image forming unit according to claim 2, wherein the sealing member is disposed at a position corresponding to a portion of the second ventilation hole at which a concentration of a discharged toner is higher than a concentration of a discharged toner at other portions of the second ventilation hole.

5. The image forming unit according to claim 1, wherein the developing device includes a first auger that supplies a first component and a second auger that stirs and supplies the first component and a second component, and wherein, in the axial direction, the sealing member is disposed at a position corresponding to only a portion of the second auger on an upstream side in a circulation direction.

6. The image forming unit according to claim 1, wherein, as viewed in a direction parallel to the flow path, at least one of a contact angle of a portion at which the sealing member is in contact with the developing device and a contact angle of a portion at which the sealing member is in contact with the guiding member is an acute angle.

7. The image forming unit according to claim 1, wherein the guiding member has a surface on a side of the developing device, the surface including a flat portion and an arc portion in a cross section perpendicular to the axial direction.

8. The image forming unit according to claim 1, wherein at least a portion of a surface of the developing device includes an arc portion in a cross section perpendicular to the axial direction, and wherein the sealing member is in contact with the arc portion of the developing device.

9. An image forming apparatus comprising:

the image forming unit according to claim 1.

10. An image forming unit comprising:

a developing device that develops an electrostatic latent image formed on an image carrier that rotates;

a guiding member that guides a recording material to the image carrier; and a sealing member that is disposed between a first ventilation hole and a second ventilation hole, the sealing member having a first end in contact with the developing device and a second end in contact with the guiding member, wherein the first ventilation hole serves as a flow path for an airflow that is generated by rotation of the image carrier, and the second ventilation hole forms the flow path for the airflow in cooperation with the first ventilation hole, wherein the guiding member has a surface on a side of the developing device, the surface having a projection that extends in an axial direction of the image carrier, wherein the projection includes a first projection; and a second projection that is further than the first projection from the second ventilation hole, and wherein a height of the first projection from the surface is higher than a height of the second projection from the surface.

11. An image forming unit comprising:

a developing device that develops an electrostatic latent image formed on an image carrier that rotates;

a guiding member that guides a recording material to the image carrier; and a sealing member that is disposed between a first ventilation hole and a second ventilation hole, the sealing member having a first end in contact with the developing device and a second end in contact with the guiding member, wherein the first ventilation hole serves as a flow path for an airflow that is generated by rotation of the image carrier, and the second ventilation hole forms the flow path for the airflow in cooperation with the first ventilation hole, wherein the guiding member has a surface on a side of the developing device, the surface having a projection that extends in an axial direction of the image carrier, wherein the sealing member has a film shape, wherein the sealing member adheres to an adherence surface provided on the guiding member, and wherein the sealing member is disposed at a position so as to overlap at least a portion of the projection as viewed in a direction perpendicular to the adherence surface.

* * * * *